US010777073B2

(12) United States Patent
Fontanili

(10) Patent No.: US 10,777,073 B2
(45) Date of Patent: Sep. 15, 2020

(54) WARNING DEVICE AND SYSTEM

(71) Applicants: Defond Electech Co., Ltd., Dongguan Guangdong (CN); Defond Components Limited, Chai Wan (HK)

(72) Inventor: Massimo Fontanili, Milan (IT)

(73) Assignees: Defond Electech Co., Ltd., Dongguan, Guangdong (CN); Defond Components Limited, Chai Wan (HK)

( * ) Notice: Subject to any disclaimer, the term of this patent is extended or adjusted under 35 U.S.C. 154(b) by 0 days.

(21) Appl. No.: 16/386,807

(22) Filed: Apr. 17, 2019

(65) Prior Publication Data

US 2019/0333362 A1 Oct. 31, 2019

(30) Foreign Application Priority Data

Apr. 27, 2018 (HK) ..... 18105498

(51) Int. Cl.
*G08B 25/01* (2006.01)

(52) U.S. Cl.
CPC ..... *G08B 25/016* (2013.01)

(58) Field of Classification Search
None
See application file for complete search history.

(56) References Cited

U.S. PATENT DOCUMENTS

2012/0013477 A1* 1/2012 Olofsson ..... G08B 21/0288 340/687
2014/0247124 A1 9/2014 Ros
2018/0103030 A1* 4/2018 Einberg ..... H04W 12/08

FOREIGN PATENT DOCUMENTS

CN 104346902 2/2015
CN 204791481 11/2015
(Continued)

OTHER PUBLICATIONS

Search Report in corresponding Hong Kong Application No. 18105498.6, dated May 2, 2018.

*Primary Examiner* — Thomas S McCormack
(74) *Attorney, Agent, or Firm* — Hovey Williams LLP

(57) ABSTRACT

A warning device for use with a computerised warning system, the warning device including: a securement mechanism configured for arrangement between at least one of a secured configuration wherein the securement mechanism is configured to secure the warning device to a person's body, or to an item of clothing or accessory worn or carried on the person's body, and, an unsecured configuration wherein the securement mechanism is configured to allow release of the warning device from securement to the person's body, or to the item of clothing or accessory worn or carried on the person's body; a sensor module configured for sensing when the securement mechanism has been arranged in to the unsecured configuration, and, for sensing at least one type of interaction with the warning device when the securement mechanism has been arranged in the unsecured configuration; and a communication module communicably-connected with a computer server of the computerised system and configured for communicating information to the computer server indicative of the securement mechanism being arranged in to the unsecured configuration and indicative of the at least one type of interaction with the warning device that is sensed by the sensor module, and whereby in response to receiving the information form the communication module, the computer server is configured for communicating a predetermined warning message corresponding to the received information.

19 Claims, 6 Drawing Sheets

(56) References Cited

FOREIGN PATENT DOCUMENTS

| | | |
|---|---|---|
| CN | 105791547 | 7/2016 |
| CN | 104287328 | 8/2016 |
| CN | 106303961 | 1/2017 |
| CN | 105577213 | 9/2018 |

* cited by examiner

WARNING DEVICE AND SYSTEM

CROSS-REFERENCE TO RELATED APPLICATIONS

The present application claims the priority benefit of Hong Kong Patent Application Serial No. 18105498.6, filed Apr. 27, 2018, entitled A WARNING DEVICE AND SYSTEM, incorporated by reference in its entirety herein.

BACKGROUND OF THE INVENTION

Technical Field

The present invention relates to the field of personal emergency warning devices and systems which may be worn on or otherwise carried by a person.

Description of Related Art

Personal warning devices are carried by persons and are activated to initiate an electronic emergency warning when an emergency arises such as a criminal activity, a medical emergency, when the person is lost, in the event of a fire, or when a person is faced with a personal security emergency. One such existing device comprises a smartphone running a software application which provides an emergency button on the smartphone screen. The person may press the emergency button to initiate transmission of the electronic emergency warning or call to be sent to a default list of people to notify them that an emergency is taking place. This solution tends to be problematic in that in an emergency situation, it may be impractical for the person to extract the smartphone in order to activate the emergency button. For instance, the smartphone may be stowed in the person's bag, a back pocket etc. which is not immediately accessible by the user and introduces a delay in response time. Even when the user has extracted the smartphone from his/her bag or pocket, he/she must then typically unlock the smartphone's password protected login screen which introduces yet a further delay in response time. Then, once the smartphone login screen is unlocked, the person must navigate to the appropriate software app in order to press the emergency button. Clearly, in a real-time emergency situation such delays may seriously affect the ability of an emergency service provider to provide assistance quickly. Furthermore, such delays in accessing and navigating through the smartphone in order to operate the emergency application may be exacerbated in an emergency situation when the person is under excessive-stress, lacking clarity of mind, and affected by a rush of adrenalin.

Another problem with certain existing warning devices is that they do not convey sufficient information to emergency service providers which may useful in determining the most appropriate and relevant emergency service provider to attend to the emergency. For instance, if an emergency situation arises relating to a person's personal security, it would be appropriate for a law enforcement service provider to be informed, or, if a person is faced with a medical emergency, it would be appropriate for a medical emergency first-aid service provider to be informed instead. Currently, due to this lack of sufficient information, several emergency service providers are generally dispatched to the scene of the emergency simultaneously including emergency service providers whose services may not ultimately be required. This is a waste of critical resources and places a burden on the public. Even with existing devices which do allow for some additional information concerning the emergency to be transmitted to the emergency service providers, for instance using a smartphone application, the person must still type in or otherwise enter the additional information manually in order to notify the emergency service providers of the nature of the emergency. This tends to be impractical and prone to delays for reasons outlined above. Moreover, the use of a smartphone as a warning device in a situation such as a robbery or a kidnapping is undesirable as the use of a smartphone or other overt warning devices may unduly panic or agitate a robber of kidnapper and further endanger the person's wellbeing. Accordingly, an alternative solution is required which allows the person to simply, quickly and discreetly convey a warning message with useful details of the emergency to the emergency service providers.

SUMMARY OF THE INVENTION

The present invention seeks to alleviate at least one of the above-described problems.

The present invention may involve several broad forms. Embodiments of the present invention may include one or any combination of the different broad forms herein described.

In one broad form, the present invention provides a warning device for use with a computerised warning system, the warning device including: a securement mechanism configured for arrangement between at least one of a secured configuration wherein the securement mechanism is configured to secure the warning device to at least one of a piece of equipment, a vehicle, a person's body, or to an item of clothing or accessory worn or carried on the person's body, and, an unsecured configuration wherein the securement mechanism is configured to allow release of the warning device from securement to the at least one of the piece of equipment, the vehicle, the person's body, or to the item of clothing or accessory worn or carried on the person's body; a sensor module configured for sensing when the securement mechanism has been arranged in to the unsecured configuration, and, for sensing at least one type of interaction with the warning device when the securement mechanism has been arranged in the unsecured configuration; and a communication module communicably-connected with a computer server of the computerised system and configured for communicating information to the computer server indicative of the securement mechanism being arranged in to the unsecured configuration and indicative of the at least one type of interaction with the warning device that is sensed by the sensor module, and whereby in response to receiving the information form the communication module, the computer server is configured for communicating a predetermined warning message corresponding to the received information.

Preferably, the securement mechanism may be configurable to adjust an amount of force required to be applied to the securement mechanism in order to arrange the securement mechanism from the secured configuration in to the unsecured configuration.

Preferably, when arranged in the secured configuration, the securement mechanism may be configured to form a loop configuration which releasably secures the warning device to at least one of a wrist, a neck, an ankle, a waist, and an arm of the person's body, or, around at least one of a buckle, a strap, a tag, and a handle of the item of clothing or accessory worn or carried on the person's body.

Typically, the securement mechanism may be configured for arrangement in to the unsecured configuration from the secured configuration by applying at least one of a pulling action, a pushing action, a twisting action, a rotating action, a squeezing action, a stretching action, a piercing action, and a tearing action to the securement mechanism.

Typically, the sensor module may be configured for sensing interaction received by the warning device in the form of at least one of a pulling action, a pushing action, a release action, a biting action, a sucking action, a blowing action, a twisting action, a rotating action, a tapping action, a shaking action, a squeezing action, a stretching action, a deformation action, a piercing action, a tearing action, and application of a thermal or infrared type input received by the warning device.

Typically, the sensor module may be configured for sensing an interaction received by the warning device in the form of at least one of a sound, moisture, a gesture, a movement, and an occlusion of light or air.

Preferably, the present invention may include a location detection module and said information communicated to the computer server includes information indicative of a location of the warning device determined by the location detection module.

Preferably, present invention may include a processor module, an input module, an output module, and a data store module operably-connected together and configured for performing functions associated with at least one of the sensor module and the communication module.

Preferably, the data store module may be configured for storing information sensed by the sensor module.

Preferably, the predetermined warning message may be indicative of at least one of a medical emergency, a criminal activity, and a fire.

Preferably, the communication module may be configured for receiving a status information from the computer server module via the communication network, said status information being indicative of at least one of a distance of the emergency service provider from, and, an estimated time of arrival of the emergency service provider to the location of the warning device, and, wherein said output module is configured for outputting the status information in the form of at least one of an aural, a tactile, and a visual output.

Typically, the present invention may include at least one of a bracelet, a necklace, a glove, a helmet, a hat, a pair of glasses, and a mouthpiece.

Typically, the communication module may be configured for communicating the information to the computer server via the communication network once a predetermined duration of time has elapsed in which the warning device has been arranged in the unsecured configuration.

Preferably, the predetermined period of time may be adjustable.

Preferably, the information communicated by the communication module to the computer server module via the communication network may be indicative of at least one of a speed of movement, a temperature, a force applied to the warning device, that is sensed by the sensor module.

It will be apparent that embodiments of the present invention provide a number of advantages over existing technology. In particular, embodiments of the present invention may assist in providing a personal warning device and system which allows the user to notify emergency service providers of an emergency in a simple, fast and discreet manner. This not alleviates delays in communicating with emergency service providers, but also, in situations where the user is being subject to criminal activity, avoids unduly panicking or agitating the criminal.

Furthermore, embodiments of the present invention conveniently allow for the release force of the securement mechanism which releasably secures the warning device to the user to be varied. Conveniently, a diverse range of users having different strengths and abilities may be able to customise the warning device for their specific abilities. Furthermore, the inclusion of an interaction module allows the user to simply, quickly and discreetly provide supplemental information indicating a specific nature of the emergency which assists in routing of the user's requests for assistance to an appropriate emergency service provider as well as better informing the emergency service provider of the situation.

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF THE PREFERRED EMBODIMENTS

Figure 1:
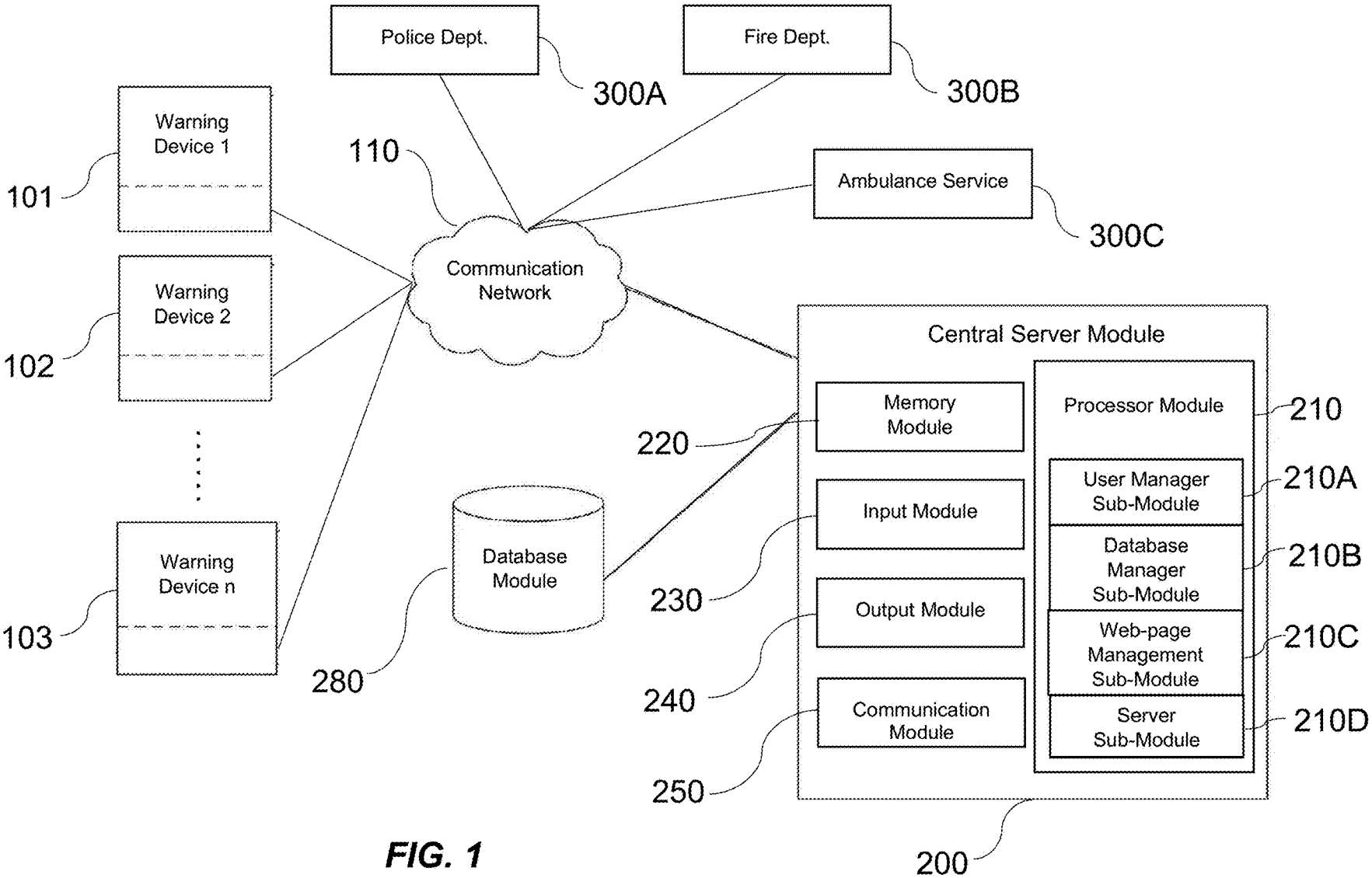
FIG. 1 shows an example computerised system for implementing embodiments of the present invention.
Figure 2:
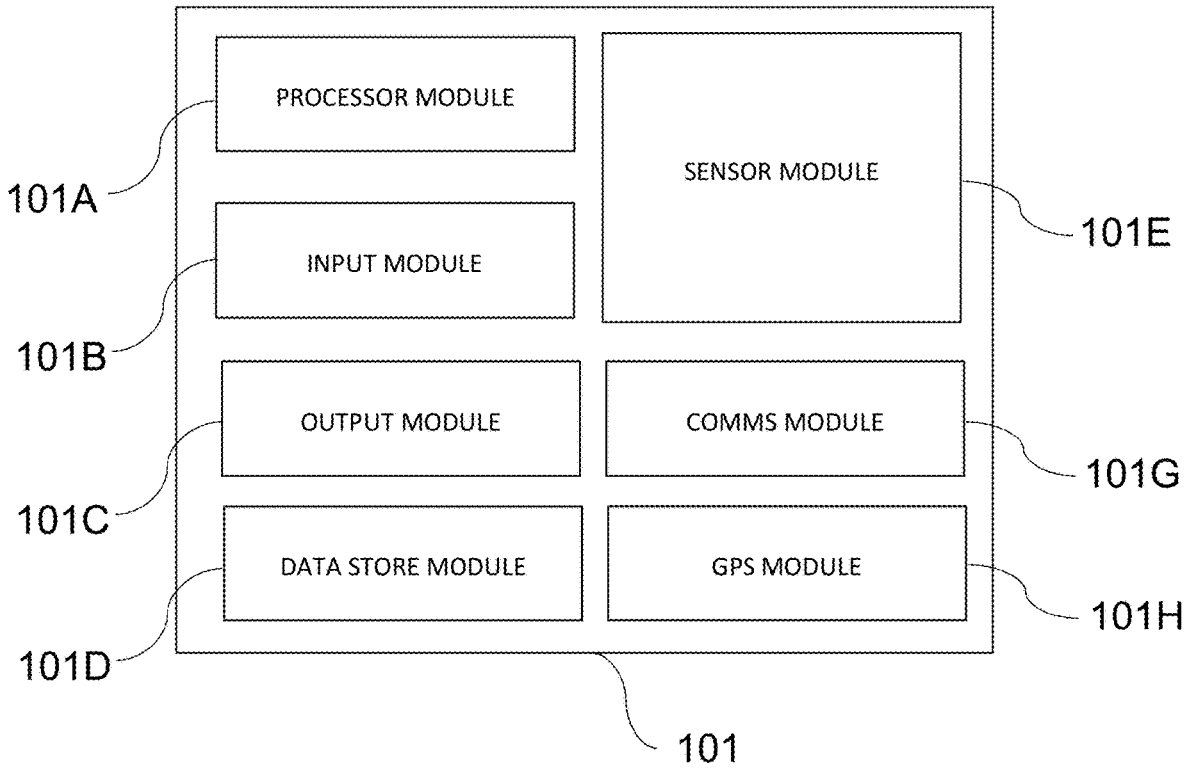
FIG. 2 shows an example functional block diagram of a warning device used in accordance with an embodiment of the present invention.

Preferred embodiments of the present invention will now be described herein with reference to the accompanying drawings FIGS. 1 to 6. Referring firstly to FIG. 1, according to one embodiment, a warning device and computerised system is shown which allows a user to alert an emergency service provider (e.g. the police department (300A), the fire brigade (300B), the ambulance service (300C)) of an emergency or potential emergency in a simple, safe and discreet manner. A plurality of users are provided with their own personal, compact and portable warning device (101,102, 103) that is releasably securable to a piece of equipment (e.g. skis, a power tool etc), to a vehicle (e.g. bicycle, motorcycle, jet ski etc), to a user's body (or to an item of clothing or accessory worn or carried by the user) as depicted in FIGS. 4A-4B, and, a computer server module (200) is communicably-connected to the warning device (101,102,103) via a communication network (110). In an emergency situation, the user may quickly and easily release the warning device (101,102,103) from securement to the piece of equipment, vehicle, user's body or item of clothing or accessory, and then interact with the warning device (101,102,103) in a variety of ways each of which indicates a type of emergency being faced by the user. Information representing these user interactions with the warning device (101,102,103) are sensed by a sensor module (101E) of the warning device (101,102,103) and communicated by a communication module of the warning device (101,102,103) to the computer server module (200) via the communication network (110). The computer server module (200) is configured to interpret the received information and in turn communicate predetermined warning messages to relevant emergency service providers (300A,300B,300C) based upon the type of emergency indicated by the received information, in order for an appropriate emergency service provider to dispatch resources to assist the user. It is envisaged that a novel warning device and system in accordance with the embodiments described herein may be useful in a diverse range of emergency situations, particularly, where it may be desirable for the user to communicate an emergency situation in a simple, fast and discreet manner. For instance, this may be advantageous in the context of a military operation where the user is required to initiate a warning message without drawing the attention of hostile parties to his/her position, or, where the user is subject to a kidnapping or armed holdup and the user does not wish to panic or agitate the assailant by overtly raising an alarm, or, where the user may be an underwater scuba diver and it is not practical to communicate a warning by voice or other conventional means.

Any one of the features of the embodiments described herein referred to as a "module" may be implemented in software for execution by various types of processors. An identified module of executable code may, for instance, comprise one or more physical or logical blocks of computer instructions which may, for instance, be organised as an object, procedure, function, or algorithm. The identified blocks of computer instructions need not be physically located together, but may comprise disparate instructions stored in different locations which, when joined logically together, comprise the module and achieve the stated purpose for the module. A module may also be implemented as a hardware circuit comprising custom circuits or gate arrays, off-the-shelf semiconductors such as logic chips, transistors, or other discrete components. A module may also be implemented in programmable hardware devices such as field programmable gate arrays, programmable array logic, programmable logic devices or the like. A module of executable code may comprise a single instruction, multiple instructions, and may be distributed over several different code segments, among different programs, and across several discrete memory devices. Similarly, operational data may be identified and illustrated herein within modules, and may be embodied in any suitable form and organised within any suitable type of data structure. The operational data may be collected as a single data set, or may be distributed over different locations including over different storage devices, and may exist, at least partially, merely as electronic signals on a system or network.

The warning device (101,102,103) used in these embodiments are relatively compact, lightweight and portable devices that may be worn on the user's body, or on an item of clothing or accessory (e.g. a handbag, purse, belt etc) that is worn or carried by or on the user's body. By way of example, the warning device (101,102,103) may be disguised as or otherwise integrally formed in an item of jewelry or article of adornment such as a wristband, a watch, necklace, a bracelet an earring, or, as an ornament, strap, tab, tassel, handle or cable of an item of clothing or accessory being worn or carried by the user. The electronic components and circuitry of the warning device may be surrounded by an outer protective layer of rubber, polymeric, leather or cloth material.

Figure 3A:
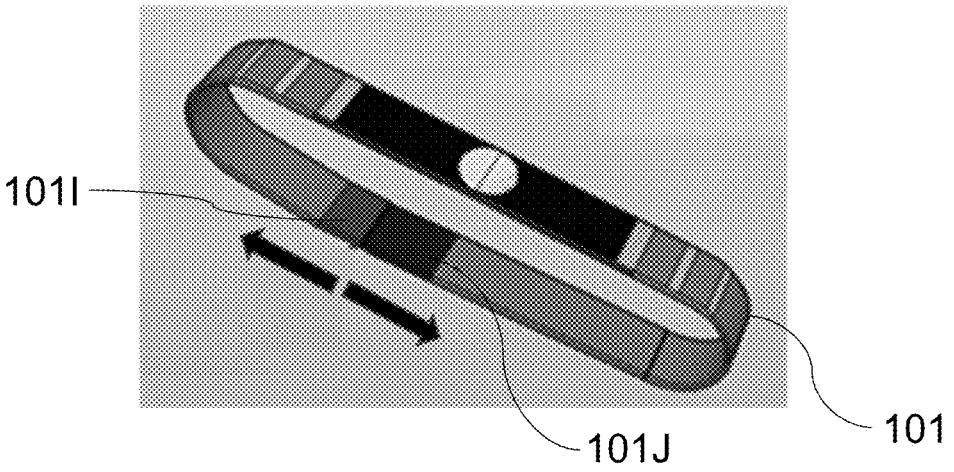
FIG. 3A shows an example warning device arranged in a secured configuration, in accordance with an embodiment of the present invention.
Figure 3B:
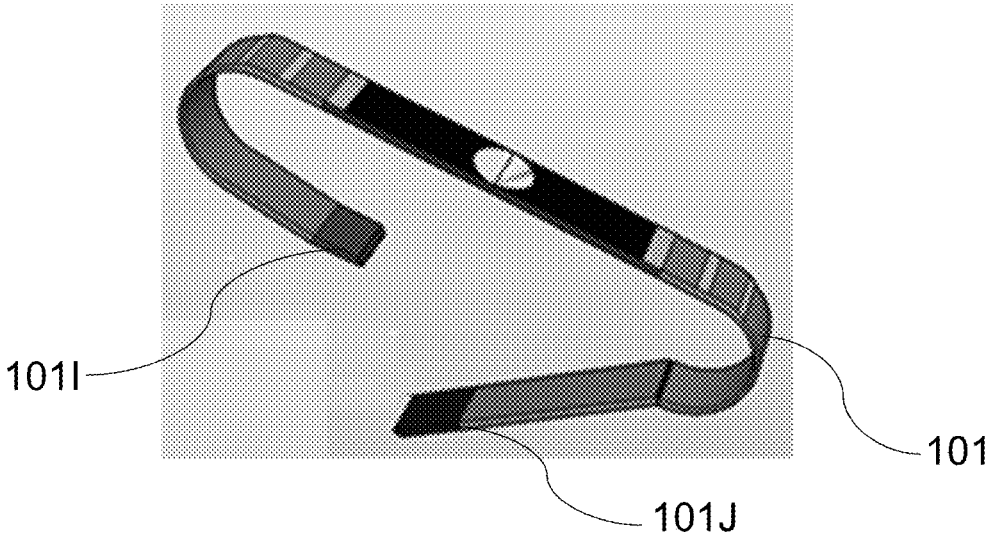
FIG. 3B shows an example warning device arranged in an unsecured configuration, in accordance with an embodiment of the present invention.
Figure 4A:
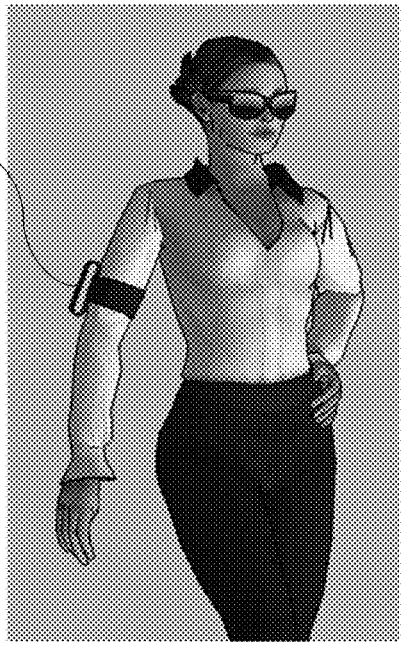
FIG. 4A shows an example of a warning device releasably secured to an armband in accordance with an embodiment of the present invention.
Figure 4B:
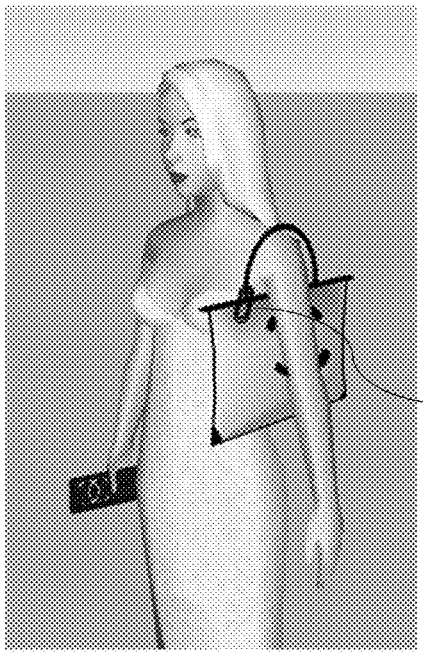
FIG. 4B shows another example of a warning device releasably secured to a handle of a handbag being carried by a user in accordance with an embodiment of the present invention.
Figure 5:
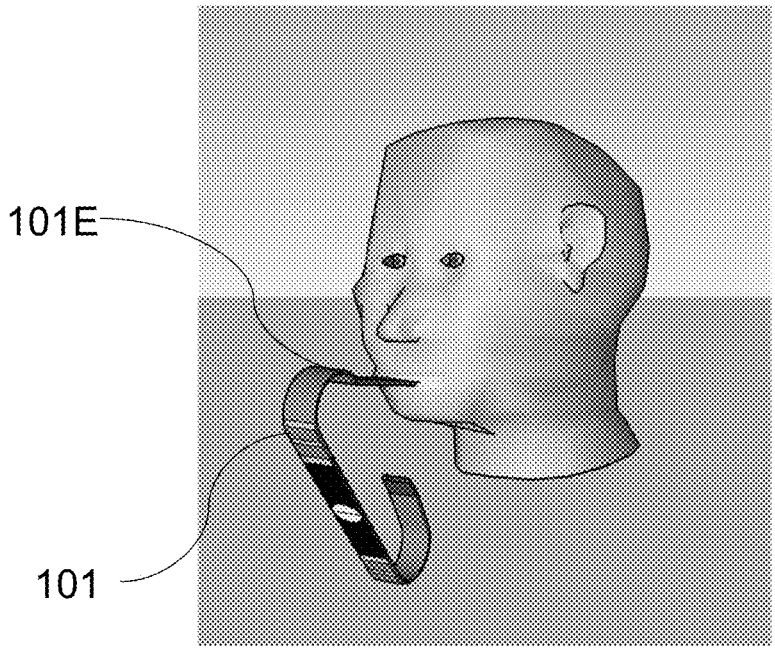
FIG. 5 shows an example of a user interaction with an interaction module of the warning device whereby the user blows in to the interaction module.

Referring now to FIGS. 3A and 3B, the warning device (101,102,103) includes a securement mechanism (101I, 101J) for releasably securing the warning device (101,102, 103) to the users body, or to the item of clothing or accessory worn or carried on the user's body. The securement mechanism (101I,101J) is arrangeable between at least one of a secured configuration (as shown in FIG. 3A) wherein the securement mechanism (101I,101J) is configured to secure the warning device (101,102,103) to a person's body, or to an item of clothing or accessory worn or carried on the person's body, and, an unsecured configuration (as shown in FIG. 3B) wherein the securement mechanism (101I,101J) is configured to allow release of the warning device (101,102, 103) from securement to the person's body, or to the item of clothing or accessory worn or carried on the person's body. In this embodiment, the securement mechanism (101I,101J) includes a first end portion (101I) and a second end portion (101J) that are releasably securable together in to a range of different secured configurations each of which results in a different amount of pulling force that is required to manually release the first end portion (101I) from the second end portion (101J) of the securement mechanism (101I,101J). Further, the first end portion (101I) may be releasably secured to the second end portion (101J) of the securement mechanism (101I,101J) by any suitable mechanism such as interference-fitting, magnetic, adhesive, or hook-and-loop type securement. By way of example, the second end portion (101J) may be formed as a sleeve and the first end portion (101I) may be wedged into the sleeve-shape of the second end portion (101J) at varying distances of insertion. The material forming the sleeve-shape second end portion (101J) may also be formed of variable stiffness, thickness, shape and/or surface texture at different regions along its length whereby the amount of force required to dislodge the first end portion (101I) from the sleeve-shaped second end portion (101J) may vary according to the distance to which the first end portion (101I) is wedged into the sleeve-shaped second end portion (101J). In alternate embodiments, the first and second end portions (101I,101J) may be releasably secured together in any other suitable manner which allows for variable amounts of force to manually release the first end portion (101I) from the second end portion (101J). For instance, the first end portion (101I) and second end portion (101J) may be magnetically secured together with varying amounts of magnetic force securing the first and second end portions (101I,101J) together depending upon the position/configuration of the first end portion (101I) relative to the second end portion (101J). Yet alternatively, the first and second end portions (101I,101J) may be adhesively secured together with the amount of force required to manually dislodge the first end portion (101I) from adhesive securement to the second end portion (101J) being variable depending upon the distance that the first end portion (101I) is overlayed on to the surface of the second end portion (101J). The ability to adjust the amount of force required to release the first end portion (101I) from the second end portion (101J) is advantageous in that the warning device may be customisable for use by a range of different user's each having different strengths and abilities. For instance, an elderly or child user may exhibit less pull strength than a middle-aged male user. In this regard, the adjustability of the amount of the release force not only ensures that a user may have the requisite strength to release the securement mechanism (101I,101J), but also, ensures that the release force is not too weak that the user may inadvertently release the securement mechanism (101I,101J) and cause a false alarm. In the above example, the first end portion (101I) is released from securement with the second end portion (101J) by applying pulling forces to the first end portion (101I) and second end portion (101J) in opposite directions as depicted by the arrows in FIG. 3B. It would also be appreciated that in alternate embodiments, the first and second end portions (101I,101J) of the securement mechanism (101I,101J) may instead be configured for release from each other by way applying a pushing action, a twisting action, a rotating action, a squeezing action, a stretching action, a piercing action, or a tearing action, in a quick, easy and discreet manner during an emergency situation to communicate a warning to the computer server module (200).

The sensor module (101E) is configured for sensing different types of user interactions received by the warning device when the securement mechanism (101I,101J) has been arranged in to the unsecured configuration. In this embodiment, the warning device comprises a processor module (101A) operably-connected to a sensor module (101E) whereby the sensor module (101E) includes one or more sensors configured for sensing when the securement mechanism has been arranged in to the unsecured configuration as well as sensing any number of different types of user interactions or any number of different combinations of user interaction types, each of which may be indicative of different types of emergencies and/or specific details of the emergency. Although the sensor module (101E) could be formed in any portion of the warning device (101,102,103), in this embodiment, the sensor module (101E) is formed in the first end portion (101I) and/or in the second end portion (101J). By way of example, the different types of user interactions sensed by the sensor module (101E) may include:

(a) moisture when the first end portion (101I) is bitten by the user;
(b) light occlusion at the first end portion (101I);
(c) pulling of the first and/or second end portions (101I, 101J);
(d) sound inputs received at the first and/or second end portions (101I,101J); and
(e) a proximity of a person or object to the first and/or second end portions (101I,101J).

In other embodiments, the sensor module (101E) may be configured for sensing yet different types of user interactions, for instance including a release action, a pushing action, a sucking action, a blowing action, a twisting action, a rotating action, a tapping action, a shaking action, a squeezing action, a stretching action, a deformation action, a piercing action, a tearing action, and/or a thermal type input received at the first and/or second end portions (101I, 101J).

Advantageously, in these embodiments, the sensor module (101E) is configured to sense user interactions with the warning device once the securement mechanism (101I,101J) has been arranged in to the unsecured configuration and the warning device (101,102,103) is able to be released from securement to the user's body—in this example, when the first and second end portions (101I,101J) have been pulled apart from each other. Whilst the first and second end portions (101I,101J) are releasably secured together, the sensors formed in the first end portion (101I) remain concealed between the secured first and second end portions (101I,101J) so as to alleviate inadvertent operation of the sensor module (101E) which may result in a false alarm occurring. Alternatively, the securement mechanism (101I, 101J) may be configured to activate operation of an electronic circuit of the interaction module upon when the securement mechanism (101I,101J) is arranged in to the unsecured configuration from the secured configuration to enable the warning device (101,102,103) to be released from securement to the user's body. For instance, movement of the first end portion (101I) away from the second end portion (101J) may actuate a switch to power the electronic circuit. It would be appreciated that yet further methods and mechanisms may be employed to prevent inadvertent operation of the sensor module (101E) before the securement mechanism (101I,101J) has been released, or, at least to prevent information being inadvertently communicated by the communication module of the warning device (101,102,103) to the computer server module (200) when there is no actual emergency.

The processor module (101A) of warning device receives the sensor readings from the sensor module (101E) and generates, by reference to the sensor readings, an interaction information which is indicative of the type of user interaction sensed by the sensor module (101E) after the securement mechanism (101I,101J) has been arranged in to the unsecured configuration as shown in FIG. 3B. In addition to the interaction information being encoded with sensed user interaction information, the interaction information is also encoded with information which identifies the user and enables the user to be authenticated by the authentication module of the computer server. The interaction information may also include timestamp information indicative of a time at which the securement mechanism (101I,101J) has been released from securement as well as location information indicating a location of the warning device (101,102,103) at the time of release of the securement mechanism. Such time information and location information may be provided by a clock and a GPS module integrally formed in the warning device (101,102,103) as part of the sensor module (101E). If the warning device (101,102,103) is configured to relay the interaction information to the computer server (200) via a smartphone device serving as an intermediate relay, then the time information and location information may be embedded into the interaction information by software running on the smartphone using the timestamp and GPS module of the smartphone.

In certain embodiments, the processor module of the sensor module (101E) may further be configured to generate information indicative of ambient sound or images (still or video) that may be sensed by a microphone and/or image capture module of the sensor module (101E). The information indicative of the ambient sound or images may be automatically recorded by a processor module operably-connected with the sensor module (101E) and embedded in to the interaction information that is communicated to the computer server module (200). The inclusion of this sound and/or image information captured around the time at which the securement mechanism (101I,101J) has been arranged in to the unsecured configuration may also provide additional useful information to the relevant emergency services providers so that they may respond in an appropriate manner. For instance, if the recorded sound includes recorded sound information is indicative of gunshots being fired, the relevant emergency service provider that receives the warning message from the computer server (in this case the police department), the police officers dispatched to the location of the person wearing the warning device may be suitably warned and prepared to deal with a potentially armed assailant, and, may be aware of the number of assailants that they are dealing with.

The warning device (101,102,103) further includes a communication module (101G) that is operably-connected with the sensor module (101E) and configured for receiving the interaction information from the processor module (101A) of the sensor module (101E) and communicating this interaction information towards the computer server (200) using any suitable short-range low power wireless communication protocol such as Bluetooth, Zigbee, Wi-Fi, NFC, or, by using a network data communication protocol such as GSM, CDMA, WCDMA, TD-SCDMA, HSPA, LTE, Wi-Max, or NB-IoT. In certain embodiments, the communication module (101G) could be paired with a smartphone that is also carried by the user whereby the warning device communicates with the computer server module (200) via the smartphone which serves as an intermediate relay device in the communication network (110). Alternatively, the communication module (101G) of the warning device (101, 102,103) may be configured to communicate information to the computer server (200) without requiring the use of a smartphone as an intermediate communication device. For instance, the communication module (101G) may be configured to communicate the information directly to a cell phone tower using a GSM or LTE communication protocol.

The computer server (200) module may comprise a processor module (210) (e.g. a microprocessor chip), an input module (230) (e.g. a keyboard, mouse etc), an output module (240) (e.g. an electronic display, speakers etc), a communication module (250), and, a data store module (220) for storing program data and user account information (e.g. the operating system, utilities application software and a database (280) of user account information) that is accessible and executable by the processor module (210) to perform the basic functionality of the computer server (200). The processor module (210) of the central server module (200) may further comprise a server management sub-module (210D), a web page management sub-module (210C), a database management sub-module (210B), and a user management sub-module (210A).

The server management sub-module (210D) is configured to perform basic processing, operating system level tasks via the underlying computer hardware. The web page management sub-module (210C) is configured for handling the creation, display and routing of interactive web pages having associated URLs which serve as a front-end interface accessible via which users and administrators are able to interact with the central server module (200) (e.g. for the purpose of opening and managing user accounts, updating user account settings etc.) using a web browser application running on a smartphone or a personal computer.

The database management sub-module (201B) is configured to perform storage and retrieval tasks with respect to database content, queries to the database module (280), read and write functions to the database module (280) and storage of data such as user account information and information received in real-time from user warning devices during operation of the system.

The user-management sub-module (210A) is configured for setting up and registering and managing user accounts for each of a plurality of users. The user accounts may be set up and registered by the users via a downloadable software application running on a smartphone, or, via a Web page interface viewable via a Web browser of a desktop computer. During the user-account setup and registration process, in addition to basic user information (e.g. sex, name, address, contact information, user-subscription payment details) the user may also be prompted to provide information concerning medical history and the contact details of their doctor, or, they may provide information concerning next of kin or other persons that should be notified by the computer server module (200) in the event of an emergency. This user-account entry is created in a database (280) stored in the data store module (220), and the information submitted by the user during the registration process is stored in the data store module (220) and associated with the newly created user account entry. A payment sub-module may be operable on the computer server module (200) which is configured to effect payment of periodic subscription fees received from users for utilisation of the warning system. Additionally, the user management sub-module (210A) is configured to support authentication of user warning devices (101,102,103) for access to and interaction with the services provided by the central server module (200).

The communication module (250) of the computer server module (200) is configured for communicating with the plurality of user warning devices (101,102,103) and for communicating with the various emergency service providers (300A,300B,300C). The communication module (250) is configured to transmit and receive information via the communication network (110) in a manner conforming to an Internet or Internet-like communication protocol. The communication module (250) is also configured to automatically communicate warning messages to each of the plurality of emergency service providers (300A,300B,300C) (for instance to a computer server of each emergency service provider) via the communication network (110) when the computer server module (200) has received information from a user device (101,102,103) indicating that the user is facing an emergency. The communication module (250) processes the interaction information received from the user warning device (101,102,103) and based upon the types of user interactions indicated by the received interaction information, is configured to communicate different warning messages corresponding to different types of interaction indicated by the received information to different emergency service providers. By way of example, responsive to the type of interaction indicated by the received interaction information, the computer server module (200) could be programmed to output warning messages to alert emergency services providers (300A,300B,300C) that the person carrying the warning device (101,102,103) is facing a medical emergency, a fire hazard, or criminal activity is taking place. The warning messages may for instance take the form of an email or any other electronic message that may be automatically communicated from the computer server to a computer terminal operable by the different emergency services providers (300A,300B,300C).

Such warning messages may be generated by communication module (250) to include details of the user, information indicating the time at which the warning device (101, 102,103) transmitted the information to the computer server (200), location information indicating the location of the warning device (101,102,103), as well as information indicating the nature of the emergency etc. Such information contained in the warning message may be collated by the communication module (250) by reference to information stored in the database sub-module (280) as well as the information received from the user warning device (101, 102,103) in real-time. The computer server module (200) may also be configured to automatically cross-reference the location information (e.g. GPS coordinates) embedded in the interaction information against data provided by a proprietary mapping service such as Google Maps® in order to obtain a street address corresponding to the location of the warning device. This street address information may be automatically communicated in the warning message to the relevant emergency services provider so that the emergency service provider is notified not only of the time of the emergency, the details of the emergency being faced, but also a real-world address that the emergency service provider can be dispatched to. In cases where the interaction information received by the computer server indicates that user is facing a medical emergency, the communication module may access the database module to retrieve any medical history information (e.g. medication history, allergies etc) from the user's account which may then be embedded in to the warning message communicated by the communication module (250) of the computer server module (200) to the relevant emergency service provider (in this case an ambulance service) as such medical history information may be critical in the application of medical treatment to the user.

In another embodiment of the present invention, a warning system as described above is provided, however, the warning device is implemented as a wearable item such as a glove (400), a helmet, a hat, a pair of glasses, boots or ski boots and a mouthpiece. Such wearable items may include an engagement member that is configured for releasable engagement with a portion of the user's body, an item of sporting equipment, a machine, or a power tool. The wearable item also includes a sensor module configured for sensing when the engagement member has been released from engagement with the object for a predetermined period of time. The wearable item also includes a communication module that is operably-connected to the sensor module and whereby, in response to the sensor module sensing that the engagement member has been released from engagement with the object for the predetermined period of time, the communication module is configured to communicate information to the computer server module via the communication network that is indicative that the engagement member is released from engagement with the object. Thereafter, upon receiving the information from the communication module of the wearable item, the computer servicer is configured to communicate a predetermined warning message to an appropriate emergency service provider by reference to the content of the received information.

In a preferred embodiment, the wearable item is formed as a glove (400) such as may be used by a motorcycle rider. The glove (400) includes finger grip members configured for releasably gripping the handlebars of the motorcycle. Tactile and/or pressure sensors are located in one or more of the finger grip regions of the glove and are operably-connected with a processor module which received sensor readings from the sensors and generates information indicative of the sensor readings. The processor module includes an inbuilt clock circuit which provides a timing reference to the processor module in order for the processor module to determine when the predetermined period of time has elapsed without the gripping member of the glove gripping the handlebars.

In certain embodiments, the sensors in the glove may be configured to sense when the engagement member is released from engagement with the handlebar by sensing a zero or negligible force applied to the finger grip region of the glove. Additionally, the sensors in the glove may also be configured to sense a speed of movement, a temperature, a force applied to the wearable item, and a change thereof of the warning device. Such sensor readings may also be embedded by the processor module in to the information that is communicated to the computer server module. Such information may also be indicative of the reason why the glove is no longer in gripping contact with the handlebars. For instance, if the sensors sense that the waring device has undergone a rapid deceleration from a relative high speed to a relative low speed, then this may be indicative of the user having been involved in a crash.

In this embodiment, the communication module of the glove automatically communicates a warning message to the computer server after a predetermined period of time has elapsed without the gripping member of the glove being sensed as gripping the handlebars of the motorcycle. The glove may further include an interaction module configured to operate in a similar manner as described above in respect to the other embodiments of the present invention. That is, after the gripping members have been released from gripping the handlebars of the motorcycle, the interaction module may sense different types of user interactions, and, such user interactions being represented by an interaction information that is able to be communicated by the communication module of the glove to the computer server. The computer server, in turn is able to interpret specific details of the emergency based upon the additional user interactions received by the interaction module of the glove and to then communication this additional information to an ambulance service that is dispatched to assist the user.

Figure 6:
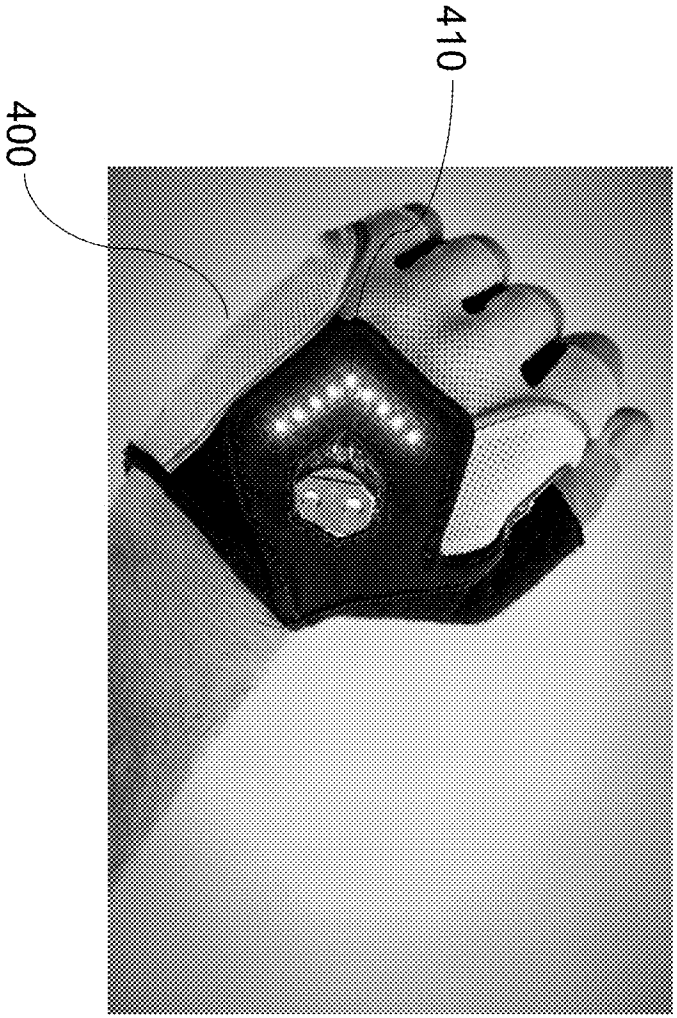
FIG. 6 shows another embodiment of the present invention in the form of a glove.

In any of the embodiments described above, the waning device may include an output module configured for outputting a status information indicative of a status information representing an estimated time of arrival of the emergency service provider to the location of the warning device, and/or, an estimated distance of the emergency service provider from the warning device. Such status information may be communicated by the computer server to the communication module of the warning device via the communication network in real-time. By way of example, the output module may include a visual output module, an aural output module, or a tactile/haptic type output module each of which may be configured to varying output types indicative of a distance and time of arrival of the emergency service provider to the warning device. For simplicity the output provided by each type of output module may be increasingly accentuated as the emergency service provider approaches the location of the warning device. Referring to FIG. 6, it can be seen that the glove embodiment employs a plurality of LED lighting elements (410) disposed upon the glove to provide an output lighting mode indicative of the status of the emergency service provider. Additionally, a tactile/haptic type output module may be employed in the glove, such that the glove is caused to vibrate with increasing vibrational strength as the emergency service provider is increasingly nears the location of the warning device. The output module may also be configured to output a visual, aural or tactile/vibration output to the user to notify the user that information has been communicated to the computer server informing the computer server that an emergency is taking place. Where the warning device may be used in circumstances where the user may be subject to criminal activity, a tactile/haptic type output module may be more suitable for use in the warning device as such vibratory output may be less obvious to other parties.

In certain embodiments, the user is able to customise the operational settings of the warning system so that the computer server will associate specific types of user interactions received by the interaction module with specific types of emergencies. By way of example, the user may download a software application into a smartphone from an online software application server which is executable by the smartphone to provide an interactive graphical user-interface operable on the interactive touch-sensitive display of the smartphone. The software application may allow the user to pair the smartphone to the warning device and to controllably program the operation of the processor module and sub-modules according to user-specific requirements. For instance, the user may wish to program the processor module of the glove embodiment so that the communication module in the glove will only communicate information to the computer server indicative of the gripping member no longer gripping the motorcycle handlebar after a user-specified time period. The software application may also provide a user interface by which the user may adjust the user's user account settings. For instance, the user may upload updated medical history information into the user account, updated contact details, as well as customise the operational settings of the warning system so that the computer server will associate specific types of user interactions received by the interaction module with specific types of emergencies. The user may further customise operation of the warning system via the software application interface so that in addition to communication an electronic warning message to an emergency service provider, the computer server may also automatically communicate an electronic warning message to a next of kin.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

The invention claimed is:

1. A warning device for use with a computerised warning system, the warning device including:

a securement mechanism configured for arrangement between at least one of a secured configuration wherein the securement mechanism is configured to secure the warning device to at least one of a piece of equipment, a vehicle, a person's body, or to an item of clothing or accessory worn or carried on the person's body, and, an unsecured configuration wherein the securement mechanism is configured to allow release of the warning device from securement to the at least one of the piece of equipment, the vehicle, the person's body, or to the item of clothing or accessory worn or carried on the person's body;

a sensor module configured for sensing when the securement mechanism has been arranged in to the unsecured configuration, and, for sensing at least one type of interaction with the warning device when the securement mechanism has been arranged in the unsecured configuration; and a communication module communicably-connected with a computer server of the computerised system and configured for communicating information to the computer server indicative of the securement mechanism being arranged in to the unsecured configuration and indicative of the at least one type of interaction with the warning device that is sensed by the sensor module, and whereby in response to receiving the information form the communication module, the computer server is configured for communicating a predetermined warning message corresponding to the received information, wherein the securement mechanism is configurable to adjust an amount of force required to be applied to the securement mechanism in order to arrange the securement mechanism from the secured configuration into the unsecured configuration.

2. A warning system as claimed in claim 1 wherein when arranged in the secured configuration, the securement mechanism is configured to form a loop configuration which releasably secures the warning device to at least one of a wrist, a neck, an ankle, a waist, and an arm of the person's body, or, around at least one of a buckle, a strap, a tag, and a handle of the item of clothing or accessory worn or carried on the person's body.

3. A warning device as claimed in claim 1 wherein the securement mechanism is configured for arrangement in to the unsecured configuration from the secured configuration by applying at least one of a pulling action, a pushing action, a twisting action, a rotating action, a squeezing action, a stretching action, a piercing action, and a tearing action to the securement mechanism.

4. A warning device as claimed in claim 1 wherein the sensor module is configured for sensing interaction received by the warning device in the form of at least one of a pulling action, a pushing action, a release action, a biting action, a sucking action, a blowing action, a twisting action, a rotating action, a tapping action, a shaking action, a squeezing action, a stretching action, a deformation action, a piercing action, a tearing action, and application of a thermal or infrared type input received by the warning device.

5. A warning device as claimed in claim 1 wherein the sensor module is configured for sensing an interaction received by the warning device in the form of at least one of a sound, moisture, a gesture, a movement, and an occlusion of light or air.

6. A warning device as claimed in claim 1 wherein the warning device includes a location detection module and said information communicated to the computer server includes information indicative of a location of the warning device determined by the location detection module.

7. A warning device as claimed in claim 1 wherein the warning device includes a processor module, an input module, an output module, and a data store module operably-connected together and configured for performing functions associated with at least one of the sensor module and the communication module.

8. A warning device as claimed in claim 1 wherein the data store module is configured for storing information sensed by the sensor module.

9. A warning device as claimed in claim 1 wherein, the predetermined warning message is indicative of at least one of a medical emergency, a criminal activity, and a fire.

10. A warning device as claimed in claim 1 wherein the communication module is configured for receiving a status information from the computer server module via the communication network, said status information being indicative of at least one of a distance of the emergency service provider from, and, an estimated time of arrival of the emergency service provider to the location of the warning device, and, wherein said output module is configured for outputting the status information in the form of at least one of an aural, a tactile, and a visual output.

11. A warning device as claimed in claim 1 including at least one of a bracelet, a necklace, a glove, a helmet, a hat, a pair of glasses, and a mouthpiece.

12. A warning device as claimed in claim 1 wherein the communication module is configured for communicating the information to the computer server via the communication network once a predetermined duration of time has elapsed in which the warning device has been arranged in the unsecured configuration.

13. A warning device as claimed in claim 12 wherein the predetermined duration of time is adjustable.

14. A warning device as claimed in any claim 1 wherein the information communicated by the communication module to the computer server module via the communication network is indicative of at least one of a speed of movement, a temperature, a force applied to the warning device, that is sensed by the sensor module.

15. A warning device for use with a computerised warning system, the warning device including:

a securement mechanism configured for arrangement between at least one of a secured configuration wherein the securement mechanism is configured to secure the warning device to at least one of a piece of equipment, a vehicle, a person's body, or to an item of clothing or accessory worn or carried on the person's body, and, an unsecured configuration wherein the securement mechanism is configured to allow release of the warning device from securement to the at least one of the piece of equipment, the vehicle, the person's body, or to the item of clothing or accessory worn or carried on the person's body;

a sensor module configured for sensing when the securement mechanism has been arranged into the unsecured configuration, and, for sensing at least one type of interaction with the warning device when the securement mechanism has been arranged in the unsecured configuration; and a communication module communicably-connected with a computer server of the computerised system and configured for communicating information to the computer server indicative of the securement mechanism being arranged in to the unsecured configuration and indicative of the at least one type of interaction with the warning device that is sensed by the sensor module, and whereby in response to receiving the information form the communication module, the computer server is configured for communicating a predetermined warning message corresponding to the received information, wherein the communication module is configured for receiving a status information from the computer server module via the communication network, said status information being indicative of at least one of a distance of the emergency service provider from, and, an estimated time of arrival of the emergency service provider to the location of the warning device, and, wherein said output module is configured for outputting the status information in the form of at least one of an aural, a tactile, and a visual output.

16. A warning device as claimed in claim 15 wherein when arranged in the secured configuration, the securement mechanism is configured to form a loop configuration which releasably secures the warning device to at least one of a wrist, a neck, an ankle, a waist, and an arm of the person's body, or, around at least one of a buckle, a strap, a tag, and a handle of the item of clothing or accessory worn or carried on the person's body.

17. A warning device as claimed in claim 15 wherein the sensor module is configured for sensing an interaction received by the warning device in the form of at least one of a sound, moisture, a gesture, a movement, and an occlusion of light or air.

18. A warning device for use with a computerised warning system, the warning device including:

a securement mechanism configured for arrangement between at least one of a secured configuration wherein the securement mechanism is configured to secure the warning device to at least one of a piece of equipment, a vehicle, a person's body, or to an item of clothing or accessory worn or carried on the person's body, and, an unsecured configuration wherein the securement mechanism is configured to allow release of the warning device from securement to the at least one of the piece of equipment, the vehicle, the person's body, or to the item of clothing or accessory worn or carried on the person's body;

a sensor module configured for sensing when the securement mechanism has been arranged into the unsecured configuration, and, for sensing at least one type of interaction with the warning device when the securement mechanism has been arranged in the unsecured configuration; and a communication module communicably-connected with a computer server of the computerised system and configured for communicating information to the computer server indicative of the securement mechanism being arranged in to the unsecured configuration and indicative of the at least one type of interaction with the warning device that is sensed by the sensor module, and whereby in response to receiving the information form the communication module, the computer server is configured for communicating a predetermined warning message corresponding to the received information, wherein the communication module is configured for communicating the information to the computer server via the communication network once a predetermined duration of time has elapsed in which the warning device has been arranged in the unsecured configuration.

19. A warning device as claimed in claim 18 wherein the predetermined duration of time is adjustable.

* * * * *